US005370398A

United States Patent [19]

Nguyên

[11] Patent Number: 5,370,398

[45] Date of Patent: Dec. 6, 1994

[54] CLOSE AND OPEN GAME

[76] Inventor: Thăng V. Nguyên, 714 Lenmore Ave. #B34, Rockville, Md. 20850

[21] Appl. No.: 84,169

[22] Filed: Jun. 30, 1993

[51] Int. Cl.[5] ..... A63F 9/20

[52] U.S. Cl. ..... 273/293; D21/51

[58] Field of Search ..... 273/292, 293; D21/51

[56] References Cited

U.S. PATENT DOCUMENTS 4,125,263 11/1978 Hamilton ..... 273/293

4,968,040 11/1990 McElhaney ..... 273/293

FOREIGN PATENT DOCUMENTS 1099875 9/1955 France .

*Primary Examiner*—Benjamin H. Layno

[57] ABSTRACT

A block game includes thirty-six indicia blocks. Each of the blocks has an indicia face which is divided into two square faces. In each of the square faces, dots are arranged in three horizontal rows, with each row having one or two dots. Moreover, the dots on each indicia face are arranged symmetrically about an axis of symmetry of the indicia face. In play, two indicia blocks are positioned adjacent to one another in such a manner that an edge of the first square face which has one dot lies adjacent to an edge of the second square face which has two dots, or vice versa.

5 Claims, 4 Drawing Sheets

PLAY LEVEL 1

PLAY LEVEL 2

PLAY LEVEL 3

CLOSE AND OPEN GAME

BACKGROUND OF THE INVENTION

1. Field of the Invention

The present invention pertains to the field of block games. More particularly, the present invention pertains to the field of block games having indicia faces.

2. Background of the Invention

Block games are generally known. In a "domino" game, a plurality of individual tiles are provided. One must count the number of dots on the domino tile and then make a match. Moreover, in the "domino" game, each number of dots has only one representation.

Although one may think that the present invention is similar in appearance to a "domino" game, it is completely different from the "domino" game in its basic principle and overcomes the problems which the "domino" game presents. Moreover, the present invention can be played by children as young as three years old.

SUMMARY OF THE INVENTION

In one respect, the invention relates to a block game which includes thirty-six indicia blocks. Each of the indicia blocks includes an indicia face, and each of the indicia faces is divided into two square faces by an imaginary bisector line. At least three dots and no more than six dots are arranged on each of the square faces in such a manner that an arrangement of the dots on each of the thirty-six indicia blocks is unique. According to a preferred embodiment, all of the dots on the two square faces on each of the thirty-six indicia blocks are arranged symmetrically about an axis of symmetry.

In another respect, the invention relates to a block game which includes thirty-six substantially rectangular indicia blocks, each of the indicia blocks having a indicia face, and each of the indicia faces including a unique arrangement of a plurality of dots. On each of the indicia faces, the plurality of dots are arranged in such a manner that each of the dots lies on one of eighteen points of intersection formed between three imaginary vertical lines which extend across the indicia face and six imaginary horizontal lines which extend across the indicia face, with at least one of the dots and no more than two of the dots being arranged to lay on each of the six imaginary horizontal lines. According to a preferred embodiment, all of the dots on the two square faces on each of the thirty-six indicia blocks are arranged symmetrically about an axis of symmetry.

In yet another respect, the invention relates to a block game which includes thirty-six substantially rectangular indicia blocks, each having an indicia face. Each of the indicia faces is divided into two substantially square faces by an imaginary bisector line and is provided with a plurality of dots arranged in such a manner that at least three of the dots and no more than six of the dots are provided on each of the substantially square faces. An arrangement of the dots on each of the indicia faces is unique, and, on each of the indicia faces, each of the dots is arranged so as to lay on one of eighteen points of intersection formed between three imaginary vertical lines which extend across the indicia face and six imaginary horizontal lines which extend across the indicia face, with at least one of the dots and no more than two of the dots being arranged to lay on each of the six imaginary horizontal lines, and with all of the dots on the indicia face being arranged symmetrically with respect to an axis of symmetry which extends across the indicia face.

The invention will, however, be best understood by a review of the following detailed description in conjunction with the accompanying drawings in which:

DETAILED DESCRIPTION OF THE PREFERRED EMBODIMENT

In mechanical engineering, there are two kinds of keys which may be employed to actuate the locking element in a lock-by-nut arrangement. A solid key opens a hollow locking element, and a hollow key opens a solid locking element. The principle of the "close and open" game is similar to these lock-and-key principles.

Figure 1:
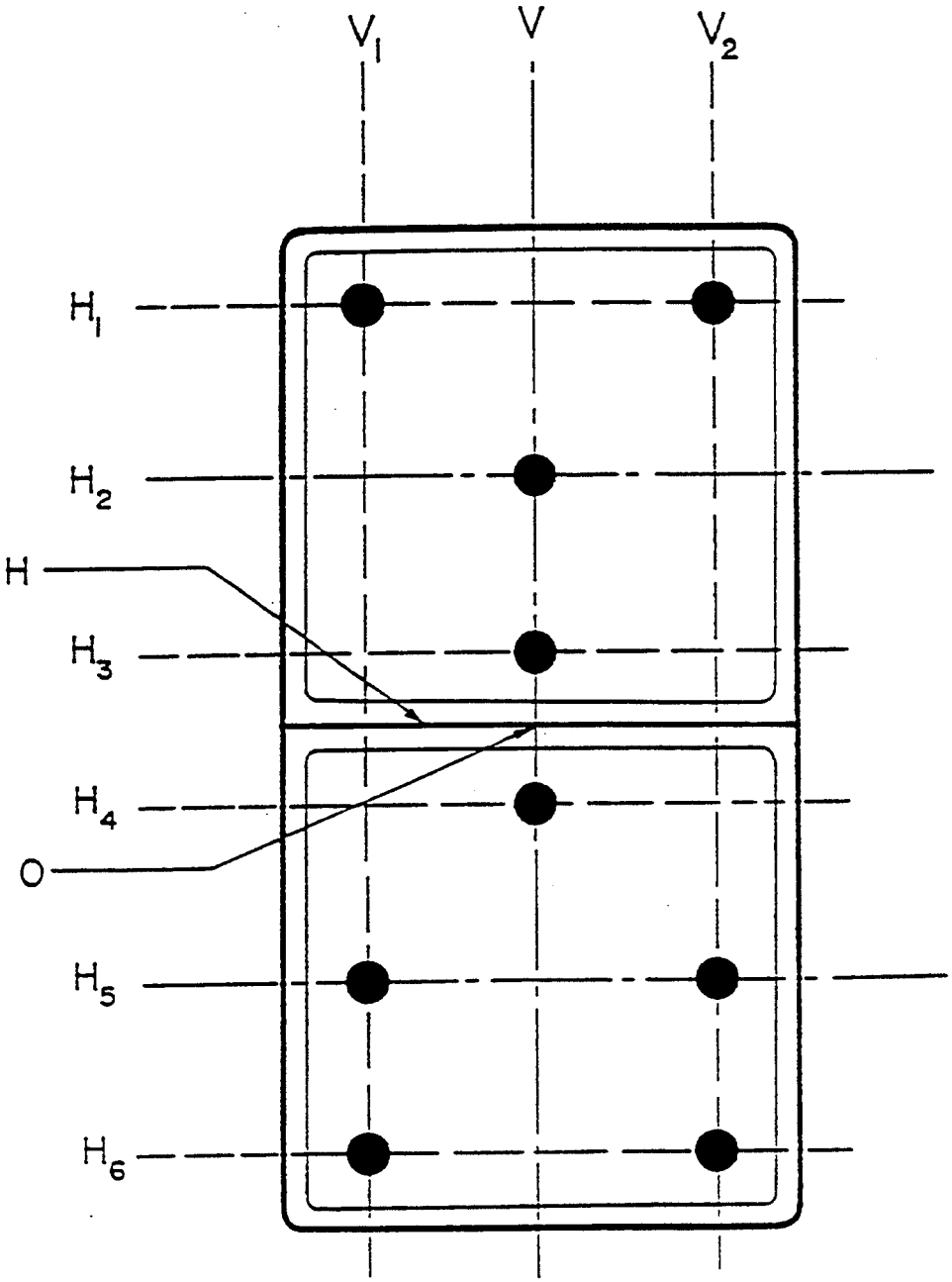
FIG. 1 is a frontal view of an indicia block of the "close and open" game according to the preferred embodiment of the invention.
Figure 2:
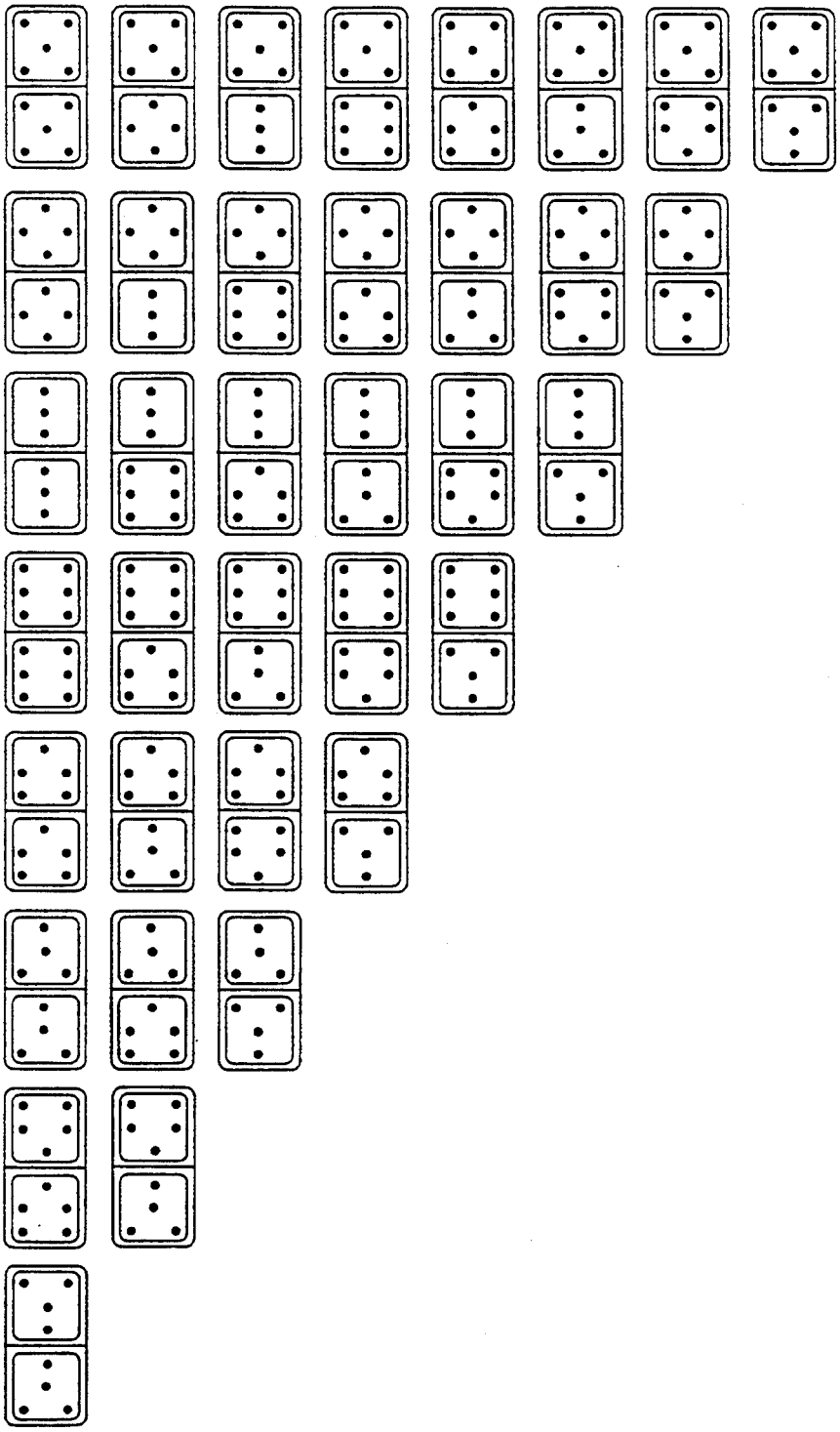
FIG. 2 shows the thirty-six indicia blocks which comprise the "close and open" game.

FIG. 1 reveals an indicia block from the "close and open" game. All thirty-six blocks of the "close and open" game have different indicia faces, as shown in FIG. 2. The basic principles of the thirty-six indicia blocks in the "close and open" game are as follows:

Each indicia block is substantially rectangular and has an indicia face which will be described with reference to ten imaginary lines ($V$, $V_1$, $V_2$, $H$, $H_1$, $H_2$, $H_3$, $H_4$, $H_5$, $H_6$).

As shown in FIG. 1, the line V is a vertical line which represents an axis of symmetry of the indicia block. The line H is a horizontal bisector which bisects the indicia face into two substantially square upper and lower faces. A point of intersection O is defined by the intersection of the axis of symmetry (represented by line V) and the bisector line H. $V_l$ and $V_2$ are vertical lines which are symmetrically disposed about the vertical line V and which extend across the two square faces of the indicia face. The lines $H_1$, $H_2$, $H_3$, $H_4$, $H_5$, and $H_6$ are horizontal lines. The horizontal lines $H_1$, $H_2$, and $H_3$ are disposed on one side of (e.g. above) the bisector line H and extend across the upper square face of the indicia face, while the horizontal lines $H_4$, $H_5$, and $H_6$ are disposed on the other side of (e.g. below) the bisector line H and extend across the lower square face of the indicia face.

Eighteen points of intersection are defined by the intersections of the lines V, $V_1$, and $V_2$ with the lines $H_1$, $H_2$, $H_3$, $H_4$, $H_5$, and $H_6$. According to the preferred embodiment of the invention, and as shown in FIG. 2, every dot on the indicia faces of the thirty-six indicia blocks in the "close and open" game can be laid upon one of these eighteen points of intersection. Furthermore, according to the preferred embodiment of the invention, and as shown in FIG. 2, all of the dots on each of the indicia faces on the thirty-six indicia blocks in the "close and open" game are symmetrically arranged about the vertical line V. Moreover, according to the preferred embodiment of the invention, and as shown in FIG. 2, each of the thirty-six indicia blocks in the "close and open" game has at least one dot and no more than two dots disposed on each one of the horizontal lines $H_1$, $H_2$, $H_3$, $H_4$, $H_5$, and $H_6$. Thus, on each square face (i.e. one half of the indicia face) of all thirty-six of the indicia blocks, there is a minimum of three dots and a maximum of six dots.

The edges and corners of the indicia blocks are preferably slightly rounded. This contributes to the safety of the indicia blocks, especially when children are playing. The back faces of the thirty-six indicia blocks can be provided with a decorative design or the like, as long as all the indicia blocks are the same in this respect.

The manner in which the "close and open" game is played is described next. As with the lock-and-key principles, the "close and open" game is played based on different touching principles: the blocks are placed adjacent one-another with the shape of one dot touching two dots.

Figure 3A:
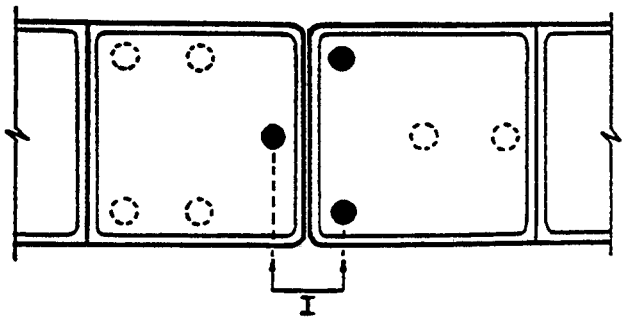
FIG. 3 shows the three layers of matching which may be employed in the rule-of-play for the "close and open" game.
Figure 4:
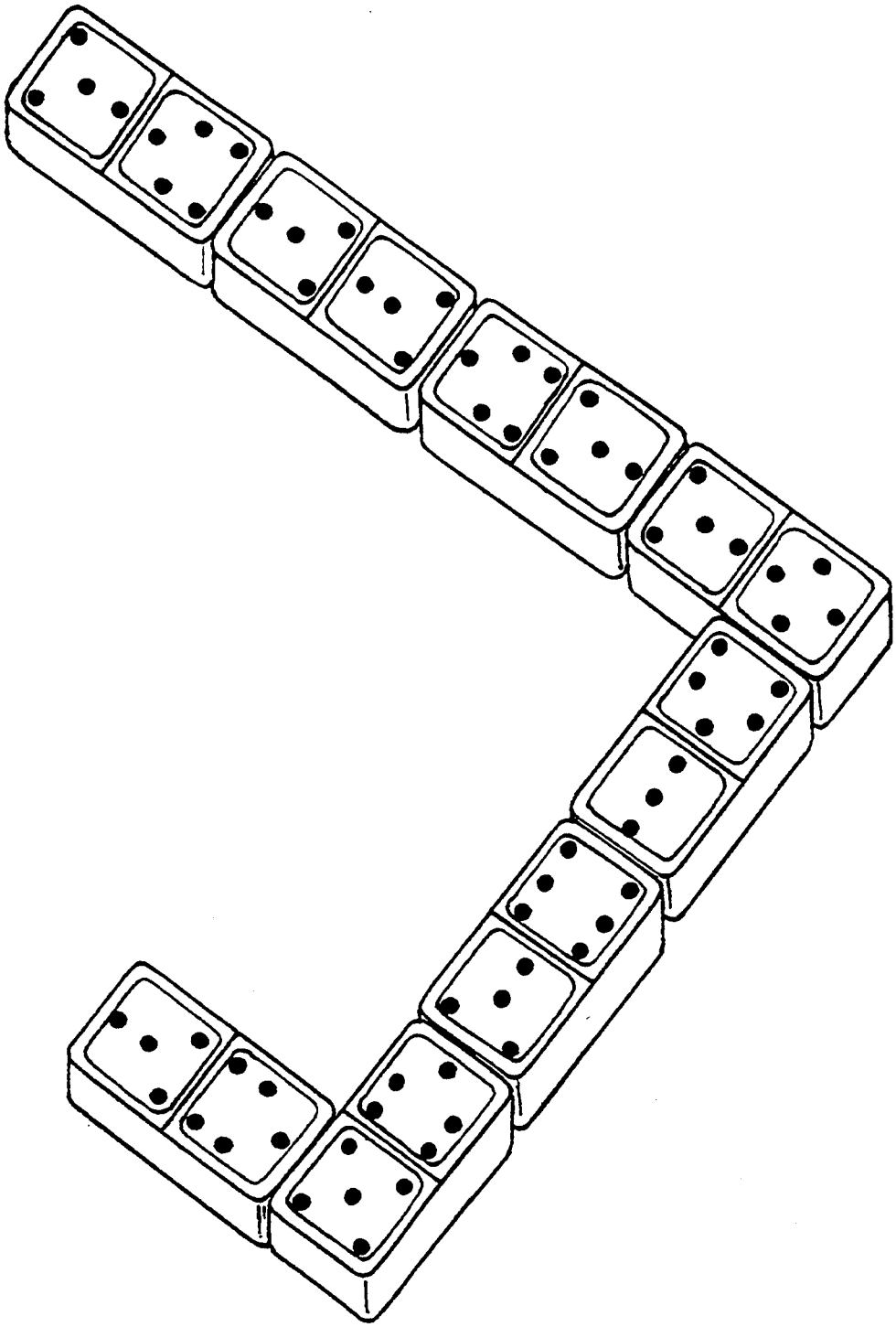
FIG. 4 shows a layout for the indicia blocks during play of the "close and open" game.

As shown in FIG. 4, a first square face of a first indicia block is placed adjacent to a second square face of a second indicia block in such a manner that an end edge of the first square face which has one dot lies adjacent to an end edge of the second square face which has two dots, or vice versa. It is like the solid key which opens the hollow locking element, or vice versa. This is the simplest rule-of-play and is also shown in FIG. 3*a*. It includes only one layer of matching dots.

The "close and open" game can be played by two players. When a new indicia block is connected to the end block of other indicia blocks, a forward direction of play is created. By adding a new indicia block to other indicia blocks, one player who has an indicia block like the right "key" can open to himself and close to another player.

Figure 3B:
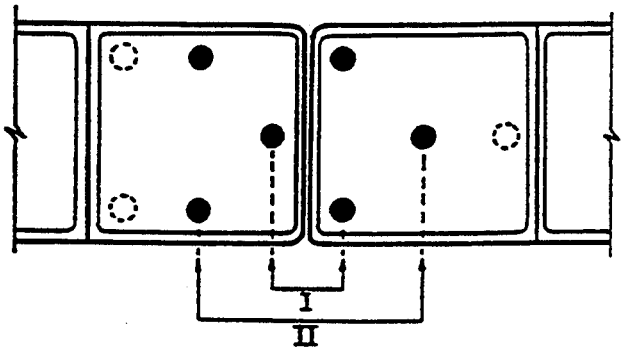
Figure 3C:
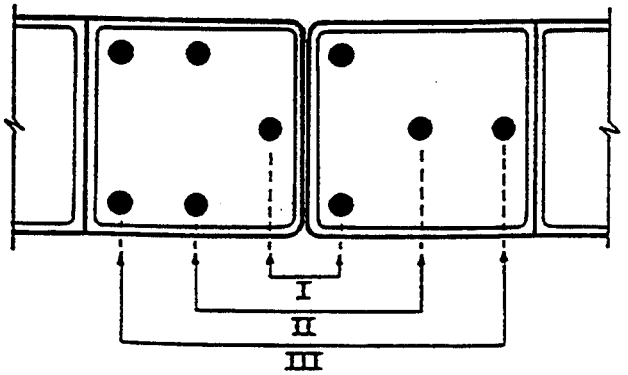

For more cognitively advanced players, the one layer of matching dots can be increased to two layers or three layers, like a two-step lock-and-key arrangement or a three-step lock-and-key arrangement. FIG. 3*b* shows the manner in which two indicia blocks are positioned to have the shape of one dot touching two dots in the first layer (or first lock-and-key step) and one dot matching two dots in the second layer (or second lock-and-key step). FIG. 3*c* shows the positioning for three layers of matching.

While the invention has been described with certain particularity, it is not meant to be limited to the above disclosed embodiment. Therefore, the invention will include the disclosed embodiment and any modifications thereof which will fall within the scope of the appended claims.

I claim:

1. A block game comprising:

thirty-six indicia blocks, each of the indicia blocks including an indicia face, wherein each of the indicia faces is divided into two square faces by an imaginary bisector line, and wherein at least three dots and no more than six dots are arranged on each of the square faces of the thirty-six indicia blocks in such a manner that an arrangement of the dots on each of the thirty-six indicia blocks is unique.

2. The block game according to claim 1, wherein for each of the thirty-six indicia blocks, all of the dots on the two square faces are arranged symmetrically about an axis of symmetry.

3. A block game comprising:

thirty-six substantially rectangular indicia blocks, each of the indicia blocks having a indicia face, and each of the indicia faces including a unique arrangement of a plurality of dots, wherein, on each of the indicia faces, the plurality of dots are arranged in such a manner that each of the dots lies on one of eighteen points of intersection formed between three imaginary vertical lines on the indicia face which extend across the length of the substantially rectangular indicia blocks, and six imaginary horizontal lines on the indicia face which extend across the width of the substantially rectangular indicia blocks, with at least one of the dots and no more than two of the dots being arranged to lay on each of the six imaginary horizontal lines of each of the indicia block.

4. The block game according to claim 3, wherein for each of the thirty-six substantially rectangular indicia blocks, all of the dots on the indicia face are arranged symmetrically about an axis of symmetry.

5. A block game comprising:

thirty-six substantially rectangular indicia blocks, each of the indicia blocks having an indicia face, wherein each of the indicia faces is divided into two substantially square faces by an imaginary bisector line and is provided with a plurality of dots arranged in such a manner that at least three of the dots and no more than six of the dots are provided on each of the substantially square faces, wherein an arrangement of the dots on each of the indicia faces is unique, and, on each of the indicia faces:

each of the dots is arranged so as to lay on one of eighteen points of intersection formed between three imaginary vertical lines on the indicia face which extend across the length of the substantially rectangular indicia blocks, and six imaginary horizontal lines on the indicia face which extend across the width of the substantially rectangular indicia blocks, with at least one of the dots and no more than two of the dots being arranged to lay on each of the six imaginary horizontal lines of each of the indicia blocks, and with all of the dots on the indicia face being arranged symmetrically with respect to an axis of symmetry which extends across the indicia face.

* * * * *